US008152112B2

(12) United States Patent
Miller et al.

(10) Patent No.: US 8,152,112 B2
(45) Date of Patent: Apr. 10, 2012

(54) GUTTER MOUNTING SYSTEM

(76) Inventors: Bradley Miller, Milwaukee, WI (US); Thomas DeFer, Milwaukee, WI (US)

( * ) Notice: Subject to any disclaimer, the term of this patent is extended or adjusted under 35 U.S.C. 154(b) by 109 days.

(21) Appl. No.: 12/576,411

(22) Filed: Oct. 9, 2009

(65) Prior Publication Data

US 2010/0200713 A1 Aug. 12, 2010

Related U.S. Application Data

(60) Provisional application No. 61/150,529, filed on Feb. 6, 2009.

(51) Int. Cl.
*E04D 13/064* (2006.01)

(52) U.S. Cl. ..... 248/48.1; 248/48.2; 52/11; 52/12; 52/15

(58) Field of Classification Search ..... 52/11, 12, 52/15, 94, 16; 248/48.1, 227.4, 227.1, 226.11, 248/48.2; 362/147, 152, 249.01
See application file for complete search history.

(56) References Cited

U.S. PATENT DOCUMENTS

| | | | | | |
|---|---|---|---|---|---|
| 1,126,854 | A | * | 2/1915 | Peterson et al. | 52/15 |
| 3,057,117 | A | * | 10/1962 | Singer | 52/11 |
| 3,193,229 | A | | 7/1965 | Stock | |
| 3,599,916 | A | * | 8/1971 | Szabo | 248/73 |
| 4,190,988 | A | * | 3/1980 | Carreiro | 52/16 |
| 4,309,792 | A | * | 1/1982 | Faye | 16/389 |
| 4,974,128 | A | | 11/1990 | Prickett | |
| 5,141,192 | A | | 8/1992 | Adams | |
| 5,548,931 | A | * | 8/1996 | Bryant | 52/11 |
| 5,566,058 | A | | 10/1996 | Protz, Jr. | |
| 5,588,261 | A | * | 12/1996 | MacConochie | 52/11 |
| 5,707,136 | A | | 1/1998 | Byers | |
| D427,510 | S | | 7/2000 | Gary et al. | |
| 6,109,765 | A | | 8/2000 | Blanton | |
| 6,364,508 | B1 | | 4/2002 | Moreland | |
| D460,912 | S | | 7/2002 | Gary et al. | |
| 6,644,836 | B1 | | 11/2003 | Adams | |
| 6,652,112 | B1 | | 11/2003 | Lucarelli | |
| 6,827,379 | B2 | * | 12/2004 | Hill et al. | 294/19.1 |
| 7,066,618 | B1 | * | 6/2006 | Little | 362/147 |
| 7,159,998 | B2 | | 1/2007 | Moreland | |
| 7,188,977 | B1 | | 3/2007 | Lough | |
| 2004/0040219 | A1 | * | 3/2004 | Bacik et al. | 52/11 |
| 2004/0257801 | A1 | * | 12/2004 | Cheema | 362/152 |

OTHER PUBLICATIONS

Online sales literature for Track System, Oct. 8, 2009, http://www.up-n-awaytrack.com/.

* cited by examiner

*Primary Examiner* — Nkeisha Smith
(74) *Attorney, Agent, or Firm* — Absolute Technology Law Group, LLC

(57) ABSTRACT

The present invention is a modular system for mounting lighting and signage. Mount components are attached to gutters by engaging the securing protuberance of the mount component with the gutter which creates tension between the gutter and the mount component. Rail components are assembled to the desired length using connector components and lights or signage are attached to a rail component using hooks. An insertion member is placed at each end of the assembled rail and the rail is guided through an opening in the mount component securing the lights or signage to the building.

13 Claims, 15 Drawing Sheets

GUTTER MOUNTING SYSTEM

CROSS-REFERENCE TO RELATED APPLICATIONS

This application claims priority to U.S. Provisional Application No. 61/150,529 filed on Feb. 6, 2009.

FIELD OF INVENTION

The present invention relates to the field of systems and devices for mounting ornamentation to roof gutters.

GLOSSARY

Figure 1A:
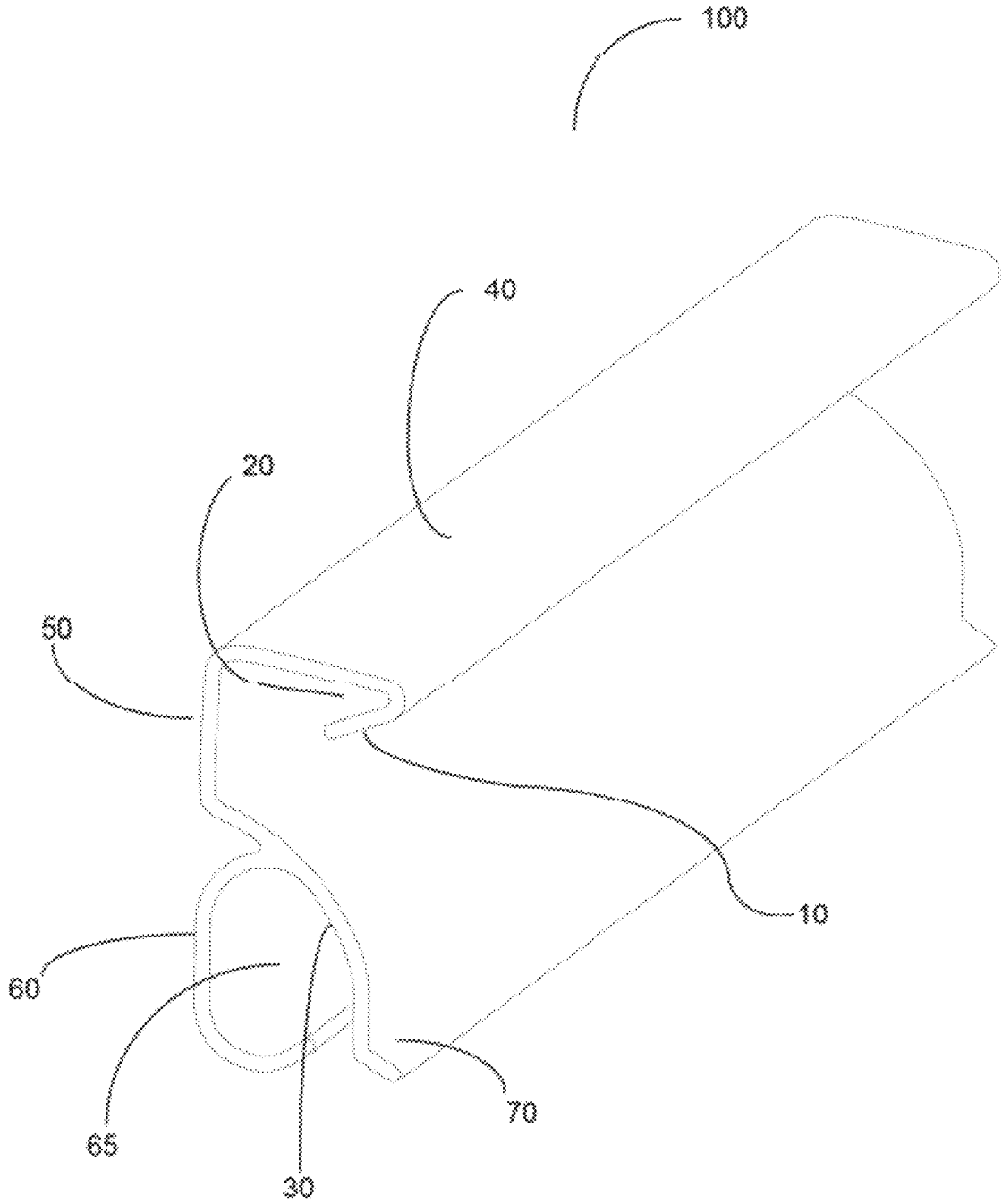
FIG. 1*a* illustrates a perspective view of an exemplary embodiment of a mount component for a modular system for mounting ornamentation to roof gutters.

As used herein, the term "mount component" refers to a component of a modular system for mounting ornamentation to roof gutters that attaches to a gutter or other structural component of a support structure and is adapted to receive a rail component.

As used herein, the term "ornamentation" means a decorative sign, indicia or embellishment, including banners, signs, lighting, foliage, decorative art, garland, wreaths, advertising, screening, logos or any other aesthetic or symbolic composition or material known in the art.

As used herein, the term "gutter contour" refers to a portion of a mount component which conforms to the k-shape, u-shape or round shape contour of any gutter known in the art.

As used herein, the term "securing protuberance" refers to the portion of a mount component which engages a gutter.

As used herein, the term "engage" means to attach or secure.

As used herein, the term "angle of engagement" refers to the angle between the top portion of the mount component and the securing protuberance. The angle of engagement facilitates and creates tension between the mount component and the gutter to enable the mount component to rest and/or be supported against the gutter. The angle of engagement is between 15 degrees and 40 degrees.

As used herein, the term "spacer component" refers to a configuration of a mount component which prevents the vertical surface portion of the mount component from resting directly against the face of a gutter.

As used herein, the term "bowed vertical surface" refers to a substantially upright surface which is bent or curved downward.

As used herein, the term "rail component" refers to a component to which ornamentation (e.g., lighting or signage) is attached and which is received by a mount component.

As used herein, the term "friction reducing ridges" refers to protuberances on the surface of the rail component which reduce friction and allow for expansion and contraction in various environments (e.g., hot and cold climactic conditions).

As used herein, the term "connector component" refers to a component used to connect two rail components to effectuate a modular system.

As used herein, the term "insertion component" refers to a component that is placed on the leading and trailing ends of a rail component to facilitate insertion of the rail component into the mount component by reducing the dimension of the structure which is being inserted in the opening.

As used herein, the term "accessory mount hole" refers to an aperture, slip, bore, hook, contour or protrusion which is adapted to receive a hook, tie or other securing component to secure an accessory, such as a light strand or a sign.

As used herein, the term "guiding hole" refers to a hole, contour or protuberance to engage a pole, rope, line, wire or any other implement or tool known art which may be used to facilitate and/or guide the rail component through mount components.

As used herein, the term "gutter" refers a water-collecting structure known in the art that has a flat side, a flat bottom and one or more curved sides with a protuberance. A curved side of a gutter may be rounded, k-shaped, u-shaped, angled, or squared.

As used herein, the term "gutter corner" refers to the point at which gutter components are adjoined, generally at an angle.

As used herein, the term "semi-rigid" refers to a material that is moderately or somewhat capable of being bent without breaking.

As used herein, "weather resistant" refers to a material that is capable of withstanding extreme cold and is protected against UV exposure.

BACKGROUND

More than 80 million Americans decorate the outside of their homes each year with Christmas lights. These lights are typically secured along the edge of the roof beneath overhangs and around the gables of homes using staples, hook or nails. Each string of lights must be secured at several places. A ladder is generally needed to reach these areas requiring the ladder to be moved each time a new staple, hook or nail is placed. Hanging lights is time consuming and dangerous, particularly when extended-height ladders are required for larger homes or home with higher roofs.

Often, lights must be professionally installed. Some homeowners elect to leave the lights up year-round to avoid labor associate with seasonal installation and removal. However, doing so leaves lighting exposed to the elements year-round which may cause deterioration of the lights and require replacement of one or more bulbs or light strands. In addition, visible, unused lighting strands detract from the appearance of the home during times of the year when the lights are not typically illuminated.

Since lighting is a seasonal item, some homeowners decorate their homes for multiple holidays and for special occasions. Consumers may elect to change the colors of the lights they display. For example, a consumer may want to use red and green or multi-colored lights during Christmas and other colors for other holidays (e.g., orange for Halloween; red, white and blue for Independence Day).

In addition to lighting, users may want to suspend or mount temporary signage for commercial uses (e.g., "For Sale") or for special occasions ("It's a Boy" or "Happy Birthday, Mary").

There are many devices known in the art to facilitate installation of lights, signage and other ornamentation on gutters. One example of a lighting system is disclosed in U.S. Pat. No. 4,974,128 (Prickett '128). Prickett '128 teaches a decorative trim lighting system, the base of which is composed of a folded plastic strip that is adhesively attached to a rain gutter or other exterior edge of a building. Although, the lighting system taught by Prickett '128 does not require the user to clip or hook the light strand directly to the building each time the lights are installed, the system still requires a user to climb a ladder and clip each tab onto the base each time the lights are installed, and to constantly move and reposition the ladder during the installation process.

An example of a lighting system available on the market which does not require repositioning of a ladder is Up-N-Away Track. Up-N-Away Track consists of a track which is attached to the edge of a building using screws. Clips are installed at approximately 1 foot intervals along a light strand. The clips are then loaded onto a storage track by sliding clips in a slot in the storage track. The clips from the storage rack are then installed on the light track by pulling the clips along the track by hand or using a puller. A cam lock is then inserted at the beginning of the light strings. A second cam lock is inserted at the other end locking the lights in place. To remove the lights, the cam locks are removed and the lights are pulled in reverse around the track. Up-N-Away Track lighting system is not desirable because it requires the user to pull directly on the light strand to install and remove the lights from the track which is difficult to do and damages the light strand.

It is desirable to have a modular system for mounting ornamentation to a roof gutter which does not require the user to move and climb a ladder at frequent intervals.

It is further desirable to have a modular system for mounting ornamentation to a roof gutter which does not require the use of staples, nails, screws or adhesive to secure it to a building.

It is further desirable to have a modular system for mounting ornamentation to a roof gutter which does not place stress on the light strands or lights.

It is further desirable to have a modular system for mounting ornamentation to a roof gutter with components that facilitate smooth motion.

SUMMARY OF THE INVENTION

The present invention is a modular system for mounting ornamentation to a roof gutter. A mount component is attached to a gutter; the securing protuberance of the mount component hooks around and engages the gutter. The shape of the securing protuberance allows the mount component to be attached to gutters having slightly varying shape and dimensions by creating tension between the mount component and the gutter.

A rail component is assembled by connecting individual rail components using connector components. Light strands are attached to a rail component by hooks which are hooked through accessory mount holes. An insertion component is attached to the leading end of the rail component and the rail component is inserted in the opening of the mount component. A second insertion component is attached to the trailing end. A pole is hooked through a guiding hole at the lead end of the rail component and is used to guide the rail component through the mount component.

To remove the lights, the rail component can then be pulled out of the mount component by pulling on the rail component directly or using a tool or implement to do so (e.g., a string or pole). The light strand can be easily removed from the rail component for storage. Alternatively, the rail component can be replaced with another rail component containing a different strand of lights or other ornamentation.

DETAILED DESCRIPTION OF INVENTION

For the purpose of promoting an understanding of the present invention, references are made in the text to exemplary embodiments of a modular system for mounting ornamentation to roof gutters, only some of which are described herein. It should be understood that no limitations on the scope of the invention are intended by describing these exemplary embodiments. One of ordinary skill in the art will readily appreciate that alternate but functionally equivalent components, materials and positioning may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1*a* illustrates a perspective view of an exemplary embodiment of mount component 100 for a modular system for mounting ornamentation to roof gutters. Mount component 100 securely engages a gutter of a roof while still allowing removal of mount component 100. Mount component 100 is comprised of top portion 40, front portion 50, contoured track mount housing 60 and gutter contour 30. In the embodiment shown, gutter contour 30 is k-shaped to conform to the shape of a k-shaped gutter known in the art. In other embodiments, gutter contour 30 may be rounded, squared, angled or u-shaped.

In the embodiment shown, mount component 100 is comprised of a semi-rigid polyvinyl chloride (PVC) that is weather resistant and which is made by extrusion. In other embodiments, mount component 100 may be comprised of another type of Top portion 40 rests on the gutter and further includes securing protuberance 10 which hooks around and engages the gutter. Angle of engagement 20 between the horizontal top portion 40 and securing protuberance 10 creates tension with standard size k style gutters and holds mount component 100 against the gutter. Gutter contour 30 conforms to the contour of a k style gutter and holds mount component 100 stably against the gutter. Front portion 50 also helps support mount component 100 while attached to a gutter. The shape and flexibility of mount component 100 allow it to be used with gutters of slightly varying shape and dimensions.

Contoured track mount housing 60 and gutter contour 30 form opening 65 which is shaped to accommodate rail component 200 (not shown). In the embodiment shown, opening 65 is oval shaped. In other embodiments, opening 65 can be of any shape which conforms to structural contours 230*a*, 230*b* (not shown) of rail component 200.

In the embodiment shown, gutter contour 30 has optional spacer component 70 which prevents mount component 100 from resting directly against the face of the gutter.

In an exemplary embodiment, mount component 100 comes in 8 foot sections; however, it may be available in lengths shorter or longer than 8 feet. In addition, mount component 100 is available in a variety of colors to match the color of commercially available gutters.

Figure 1B:
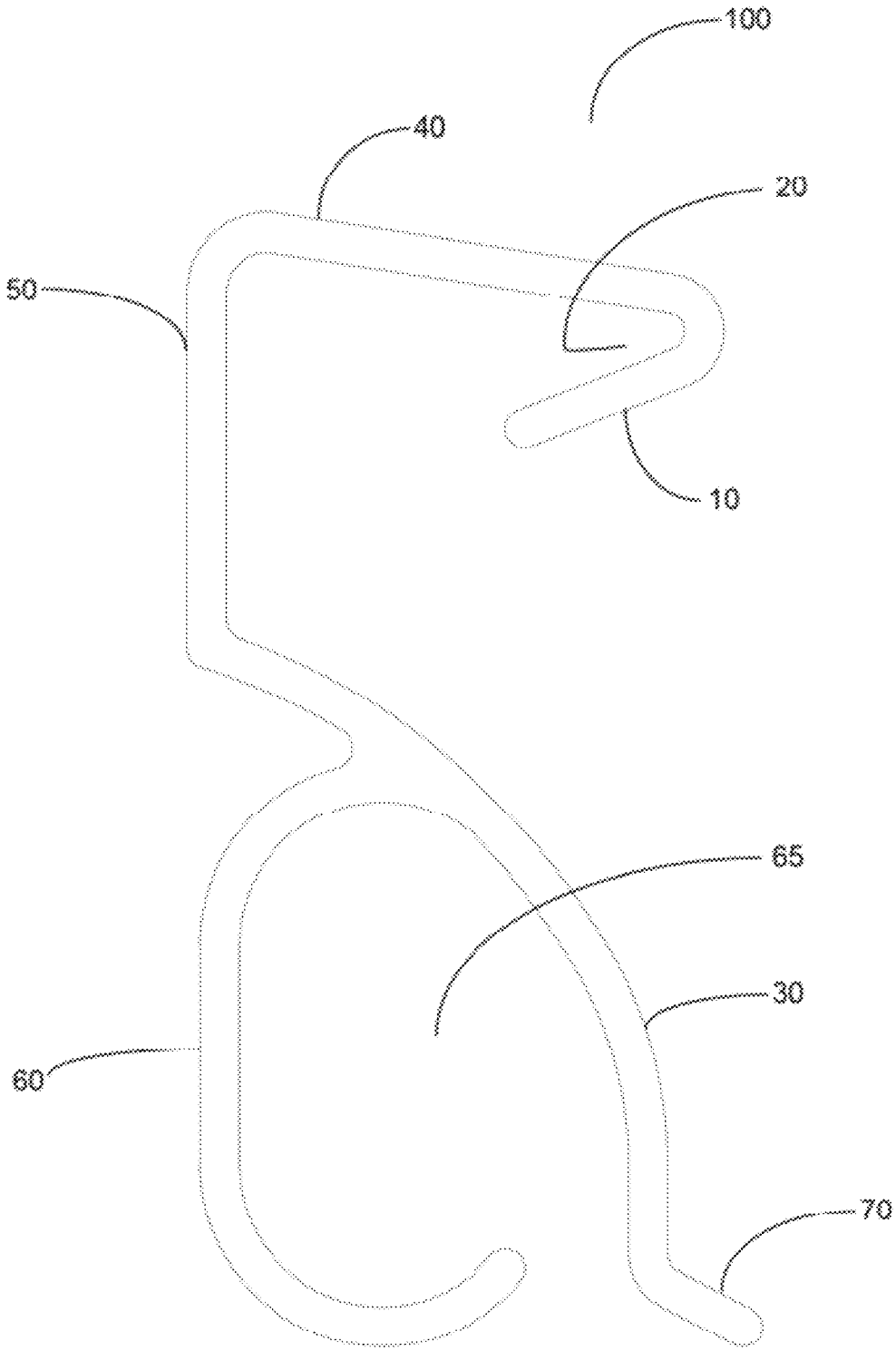
FIG. 1*b* illustrates a side view of an exemplary embodiment of a mount component for a modular system for mounting ornamentation to roof gutters.

FIG. 1*b* illustrates a side view of an exemplary embodiment of mount component 100. FIG. 1*b* further illustrates gutter contour 30 and spacer component 70.

Figure 2A:
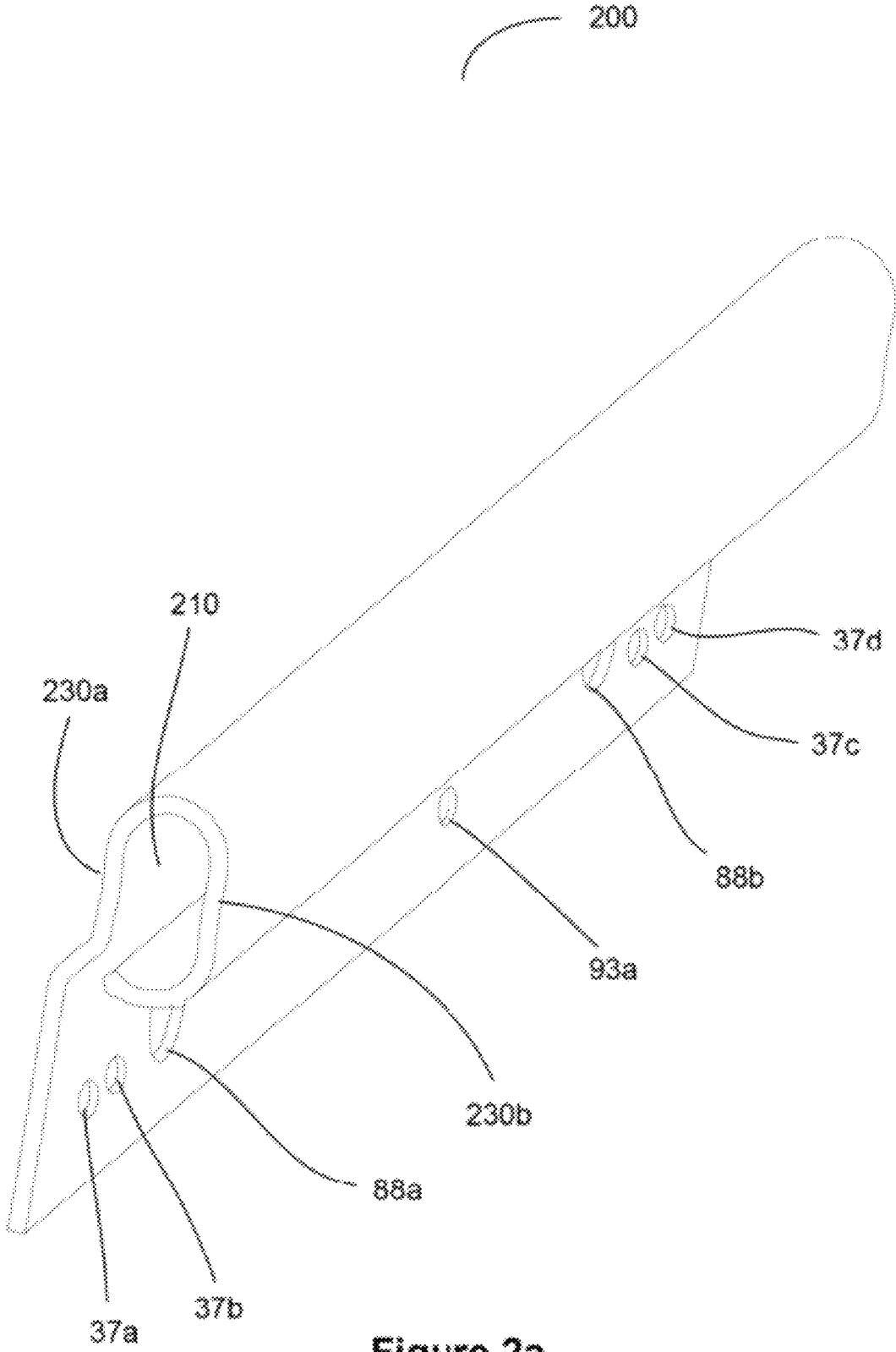
FIG. 2*a* illustrates a perspective view of an exemplary embodiment of a rail component for a modular system for mounting ornamentation to roof gutters.

FIG. 2*a* illustrates a perspective view of an exemplary embodiment of rail component 200 for a modular system for mounting lighting and signage. The shape of rail component 200 conforms to the shape of contoured track mount housing 60 and gutter contour 30 of mount component 100 and is slightly smaller in dimension so that rail component 200 can be slid between contoured track mount housing 60 and gutter contour 30 of mount component 100.

Structural contours 230*a*, 230*b* of rail component 200 form hollow channel 210 which is adapted to receive connector component 400 (not shown). Structural contours 230*a*, 230*b* are slightly smaller in dimension than contoured track mount housing 60 and gutter contour 30 so that rail component can slide within mount component 100. The slight curvature of structural contours 230*a*, 230*b* in the embodiment shown permit slight movement of rail component 200 to accommodate weight of lights or signage, but prevent pivoting of rail component 200 when secured to mount component 100.

Structural contour 230*a* has friction reducing ridges 220*a*, 220*b* which reduce friction between rail component 200 and inner surface of contoured track mount housing 60 (not shown). Friction reducing ridges 220*a*, 220*b* also allow for expansion and contraction while securing mount component 100 allowing rail component to be removed in all weather conditions, i.e., prevent rail component 200 from being stuck inside mount component 100.

Rail component 200 further includes apertures 37*a*, 37*b*, 37*c*, 37*d* adapted to receive pins of connector component 400 and guiding holes 88*a*, 88*b*. In the embodiment shown, guiding holes 88*a* and 88*b* are used to insert a pole, but in other embodiments may be used to attach other implements, such as a rope or wire. Also visible is accessory mount hole 93*b* for securing accessories (e.g., string of lights or signage). In other embodiments, rail component 200 may have more or fewer apertures, guiding holes, and/or accessory mount holes or have them in varying locations.

Figure 2B:
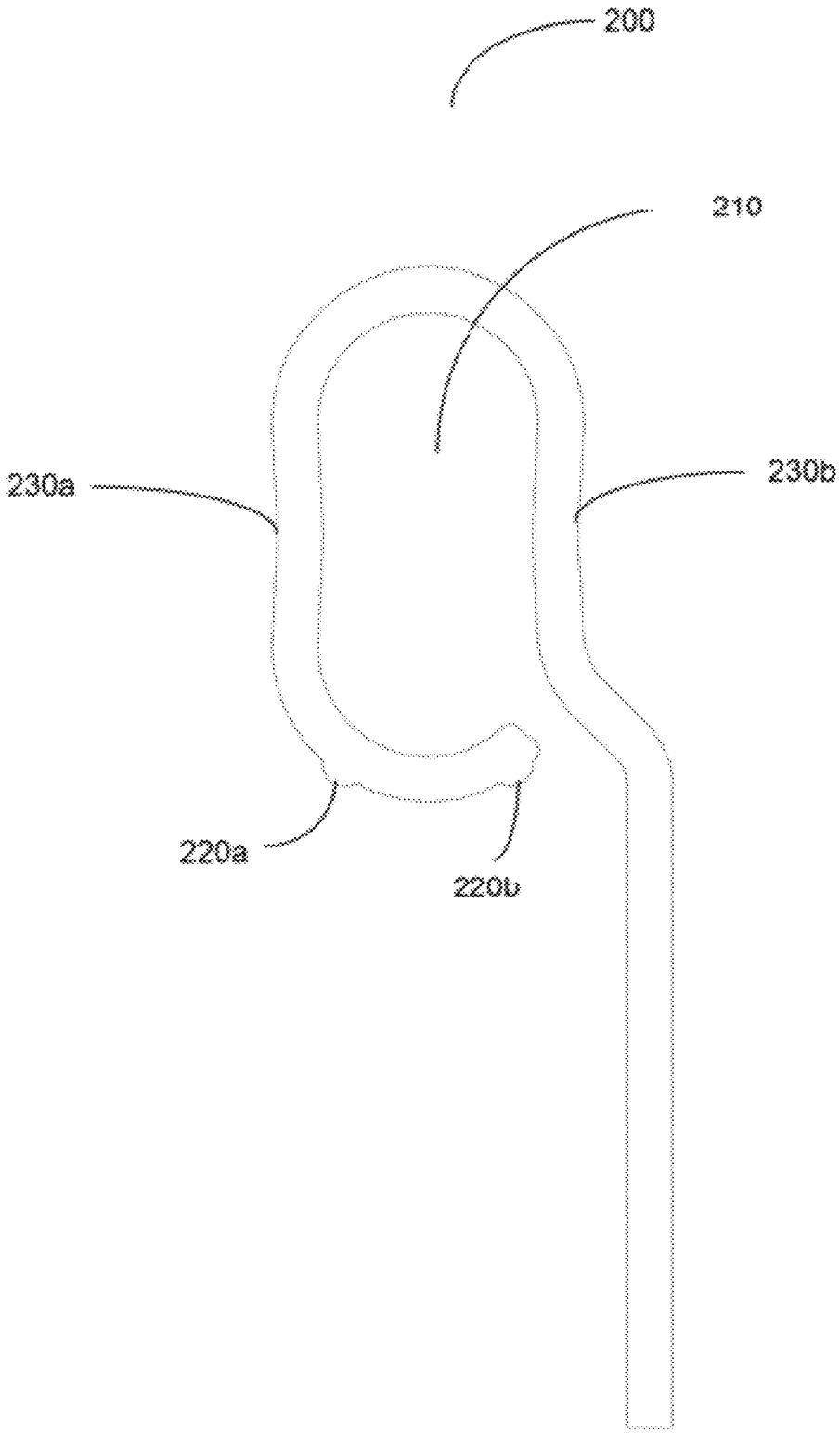
FIG. 2*b* illustrates a side view of an exemplary embodiment of a rail component for a modular system for mounting ornamentation to roof gutters.

FIG. 2*b* illustrates a side view of an exemplary embodiment of rail component 200.

Figure 3A:
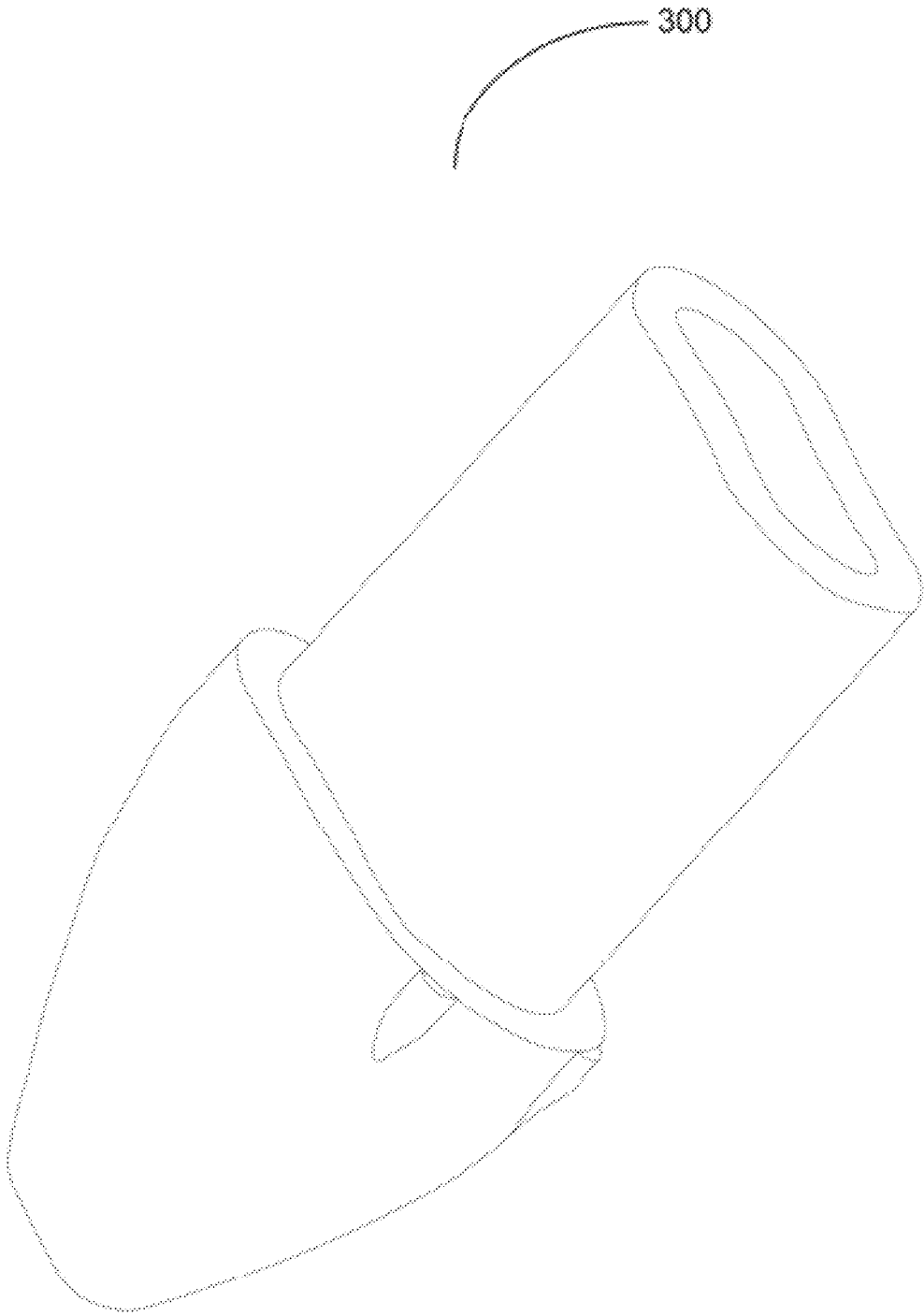
FIG. 3*a* illustrates a perspective view of an exemplary embodiment of an insertion component for a modular system for mounting ornamentation to roof gutters.

FIG. 3*a* illustrates a perspective view of an exemplary embodiment of insertion component 300 for modular system 600 (not shown) for mounting ornamentation to roof gutter. Insertion component 300 attaches to hollow channel 210 of rail component 200 (not shown) and is used to guide rail component 200 through opening 65 on mount component 100 (not shown). In the embodiment shown, insertion component 300 is hollow and is shaped and contoured to make insertion of rail component 200 easier.

Figure 3B:
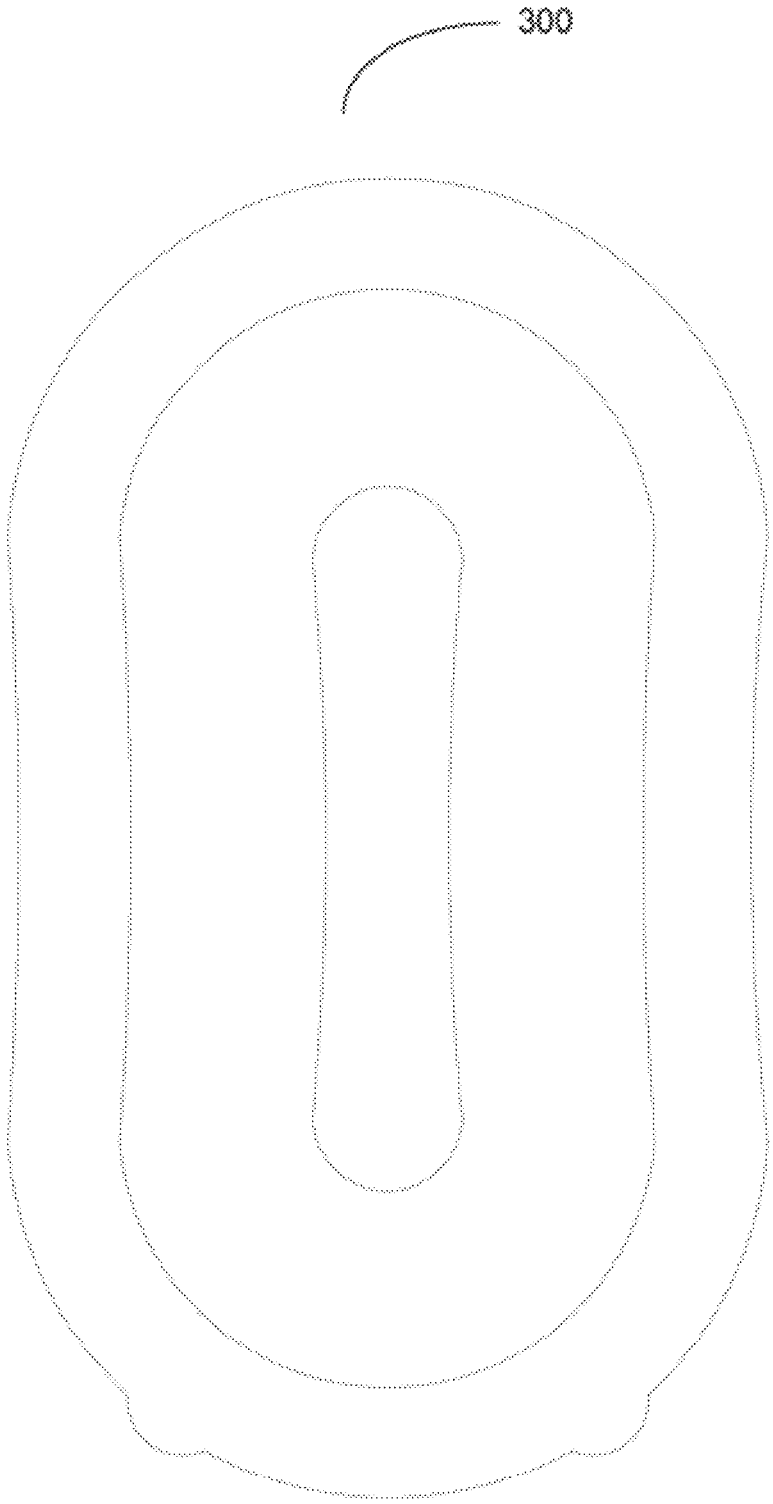
FIG. 3*b* illustrates a side view of an exemplary embodiment of an insertion component for a modular system for mounting ornamentation to roof gutters.

FIG. 3*b* illustrates a side view of an exemplary embodiment of insertion component 300. Visible are the contours of insertion component 300 which correspond to structural contours 230*a*, 230*b* of rail component 200.

Figure 4:
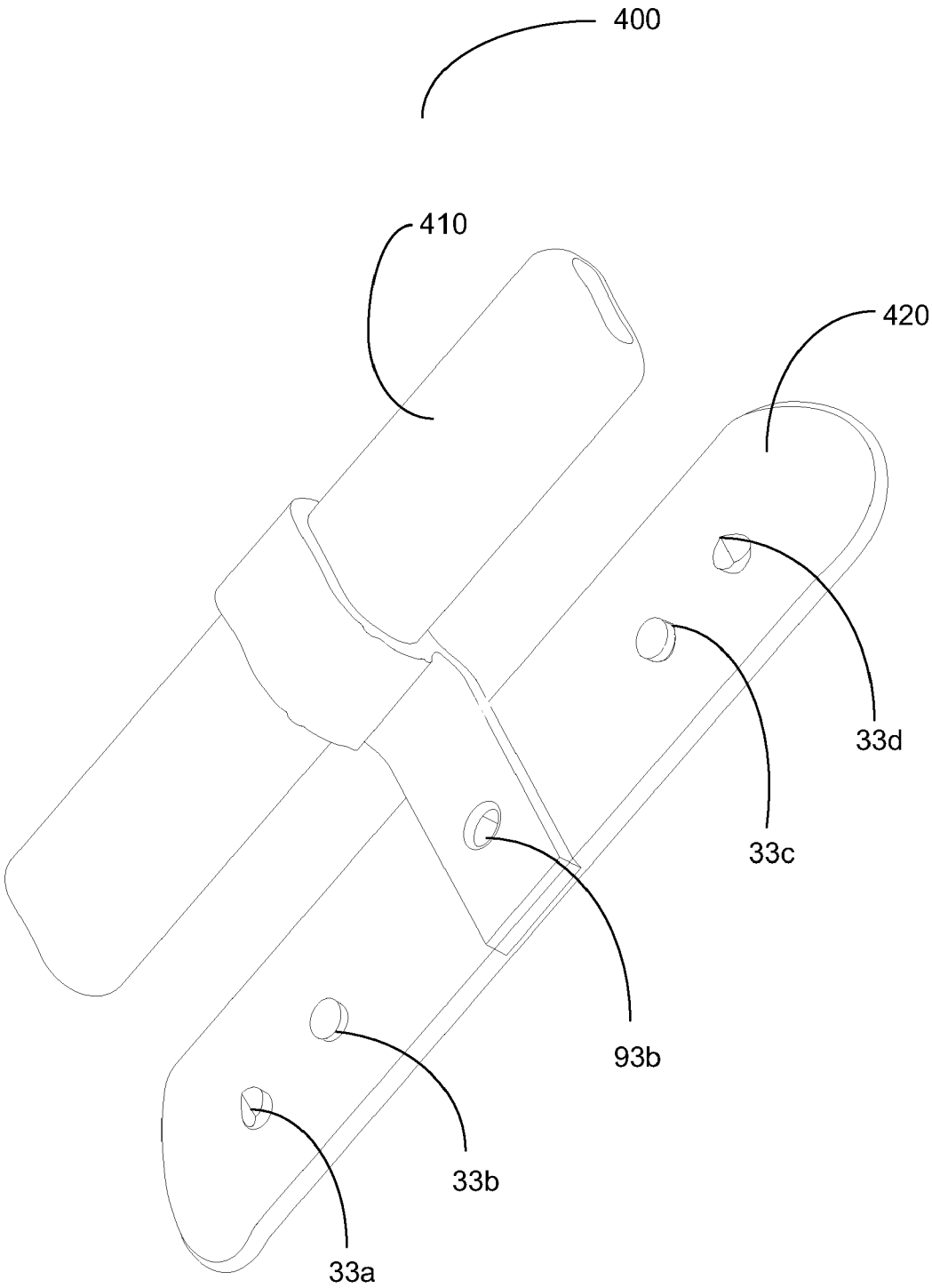
FIG. 4 illustrates a perspective view of an exemplary embodiment of a connector component for a modular system for mounting ornamentation to roof gutters.

FIG. 4 illustrates a perspective view of an exemplary embodiment of connector component 400 for modular system 600. Connector component 400 connects two rail components 200 (not shown) before guiding rail components through mount components 100 (not shown) allowing rail components 200 to be inserted through mount components 100 as one piece instead of as individual pieces.

Connector component 400 is comprised of slide member 410 and back portion 420. Slide member 410 slides into hollow channel 210 of rail component 200. Back portion 420 has pins 33*a*, 33*b*, 33*c*, 33*d* which fit into apertures 37 of rail component 200 and accessory mount hole 93*b*. Accessory mount hole 93*b* remains accessible when connector 400 is connecting two rails components and can be used to secure an accessory. In the embodiment shown, accessory mount hole 93*b* has a recessed shoulder so that the same hook can be used to secure an accessory as is used for accessory mount holes (e.g., 93*a*) on rail component 200, i.e., the same hooks can be used for all accessory mount holes.

Figure 5A:
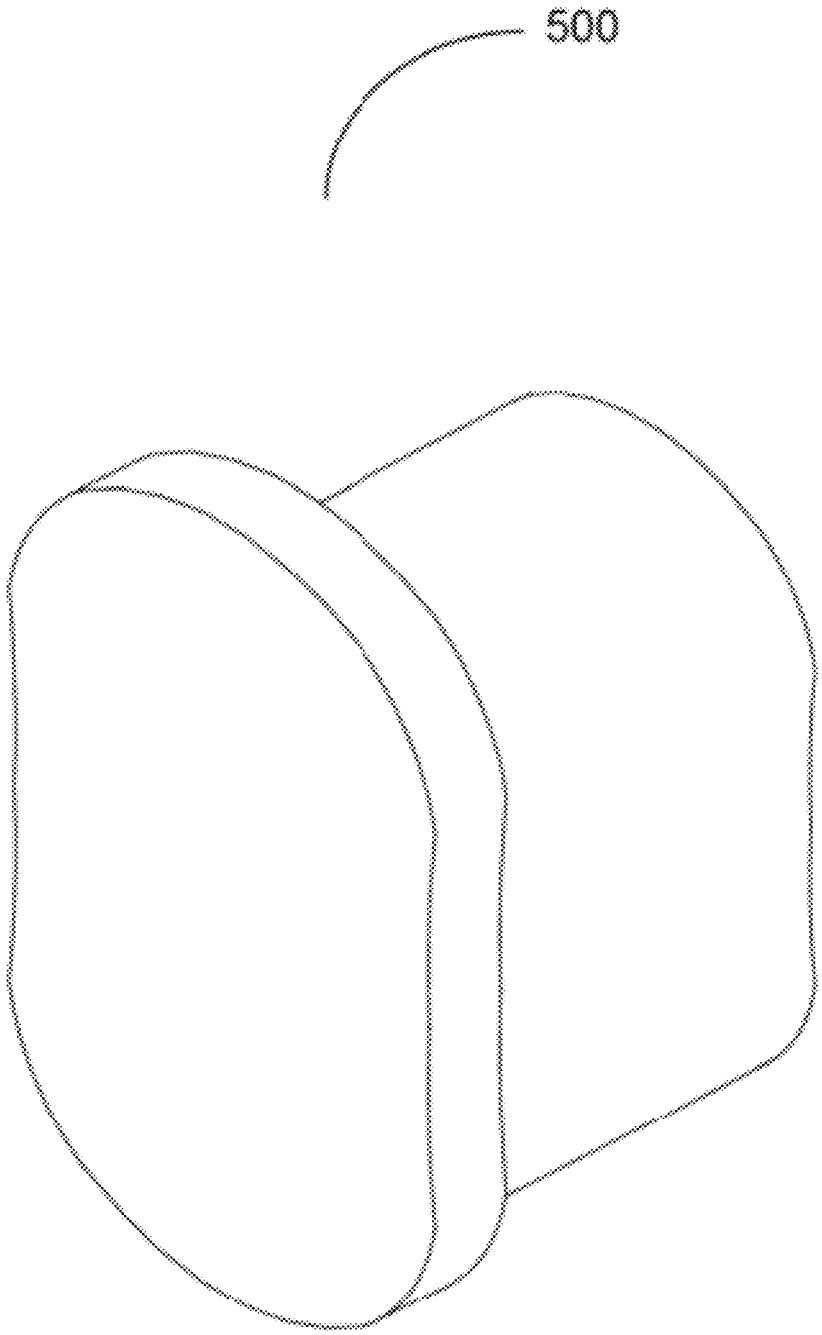
FIG. 5*a* illustrates a perspective view of an exemplary embodiment of an end cap component for a modular system for mounting ornamentation to roof gutters.

FIG. 5*a* illustrates a perspective view of an exemplary embodiment of optional end cap component 500 for modular system 600 (not shown). End cap 500 may be placed at each end of mount components enclosing opening 65 (not shown) after modular system 600 is assembled and in place on a supporting structure.

Figure 5B:
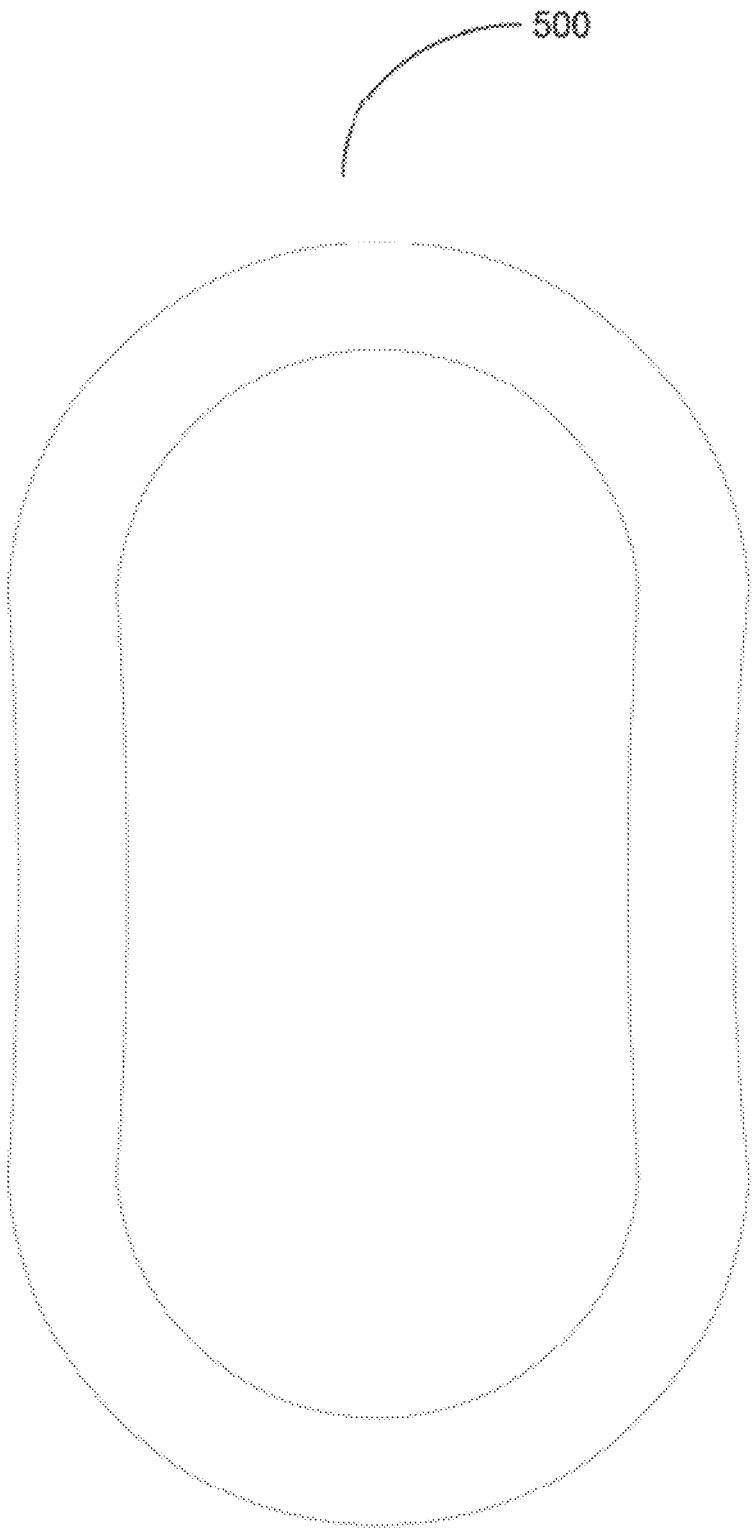
FIG. 5*b* illustrates a side view of an exemplary embodiment of an end cap component for a modular system for mounting ornamentation to roof gutters.

FIG. 5*b* illustrates a side view of an exemplary embodiment of end cap component 500.

Figure 6:
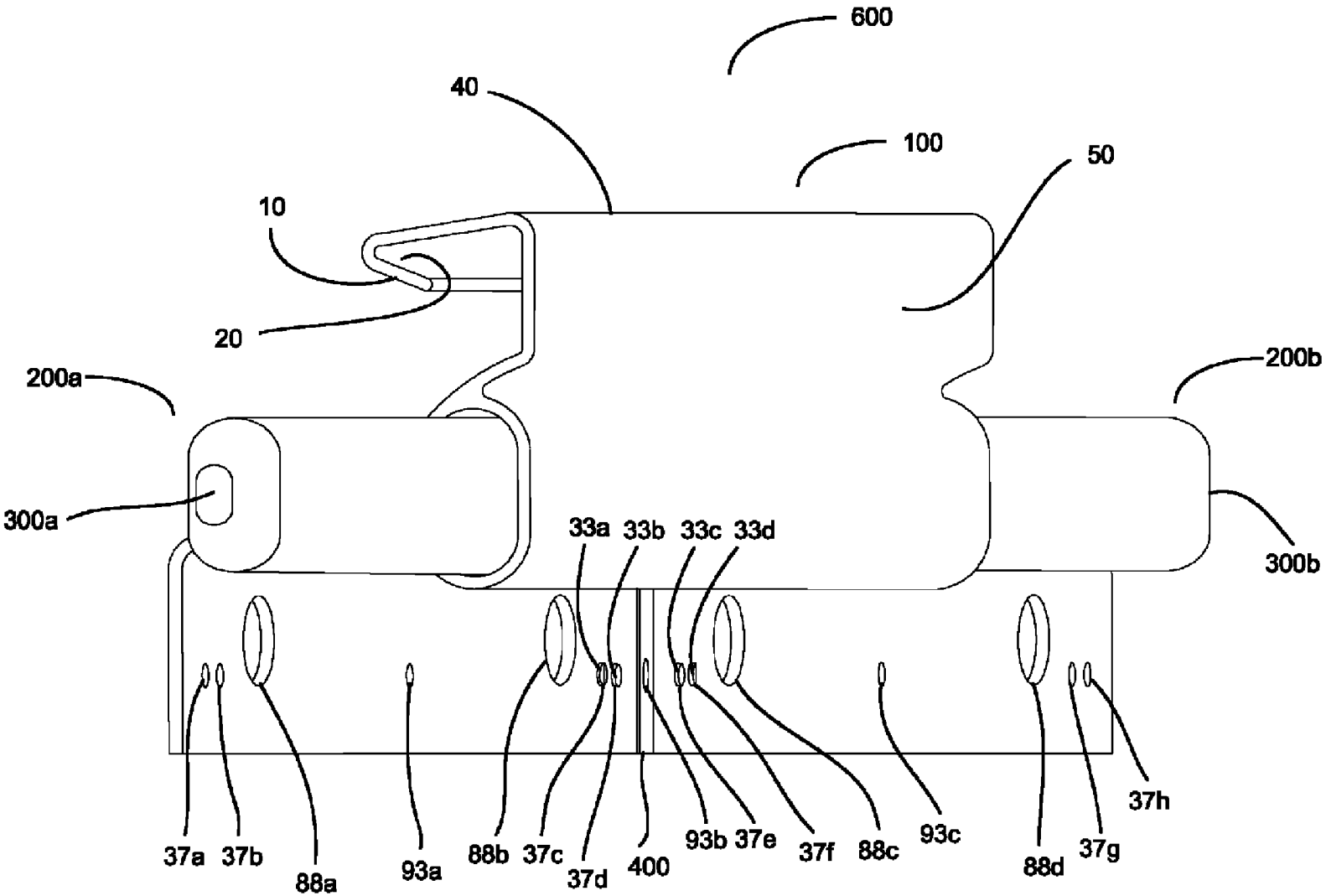
FIG. 6 illustrates a perspective view of components for a modular system for mounting ornamentation to roof gutters.

FIG. 6 illustrates a perspective view of modular system 600 comprised of mount component 100, rail components 200*a*, 200*b*, connector component 400 and optional insertion components 300*a*, 300*b* assembled.

Rail components 200*a*, 200*b* are connected by connector component 400. One end of slide member 410 of connector component 400 is slid into hollow channel 210 of rail component 200*a* and pins 33*a*, 33*b* are pressed into apertures 37*c*, 37*d* of rail component 200*a*. The other end of slide member 410 is slid into hollow channel 210 of rail component 200*b* and pins 33*c*, 33*d* are pressed into apertures 37*e*, 37*f* of rail component 200*b*. Once connected, rail components 200*a*, 200*b* are slid through opening 65 of mount component 100. In the embodiment shown, optional guide components 300*a*, 300*b* have been added to the outer ends of rail components 200*a*, 200*b* to enclose hollow channel 210.

Also visible are guiding holes 88*a*, 88*b*, 88*c*, 88*d* for hooking pole 80 (not shown) used to slide rail components through mount components during installation and accessory mount holes 93*a* (rail component 200*a*), 93*b* (connector component 400), 93*c* (rail component 200*b*).

In the embodiment shown, each rail component 200*a*, 200*b* has a length of 1 foot with accessory mount holes 93*a*, 93*c* centered lengthwise resulting in accessory mount holes spaced 6 inches apart. Mount component 100 also has a length of 1 foot and connector component 400 a length of 3 inches. In other embodiments, rail components, mount components and connector components are shorter or longer and/or have a fewer or greater number of accessory mount holes or varying spacing of apertures and accessory mount holes.

Figure 7:
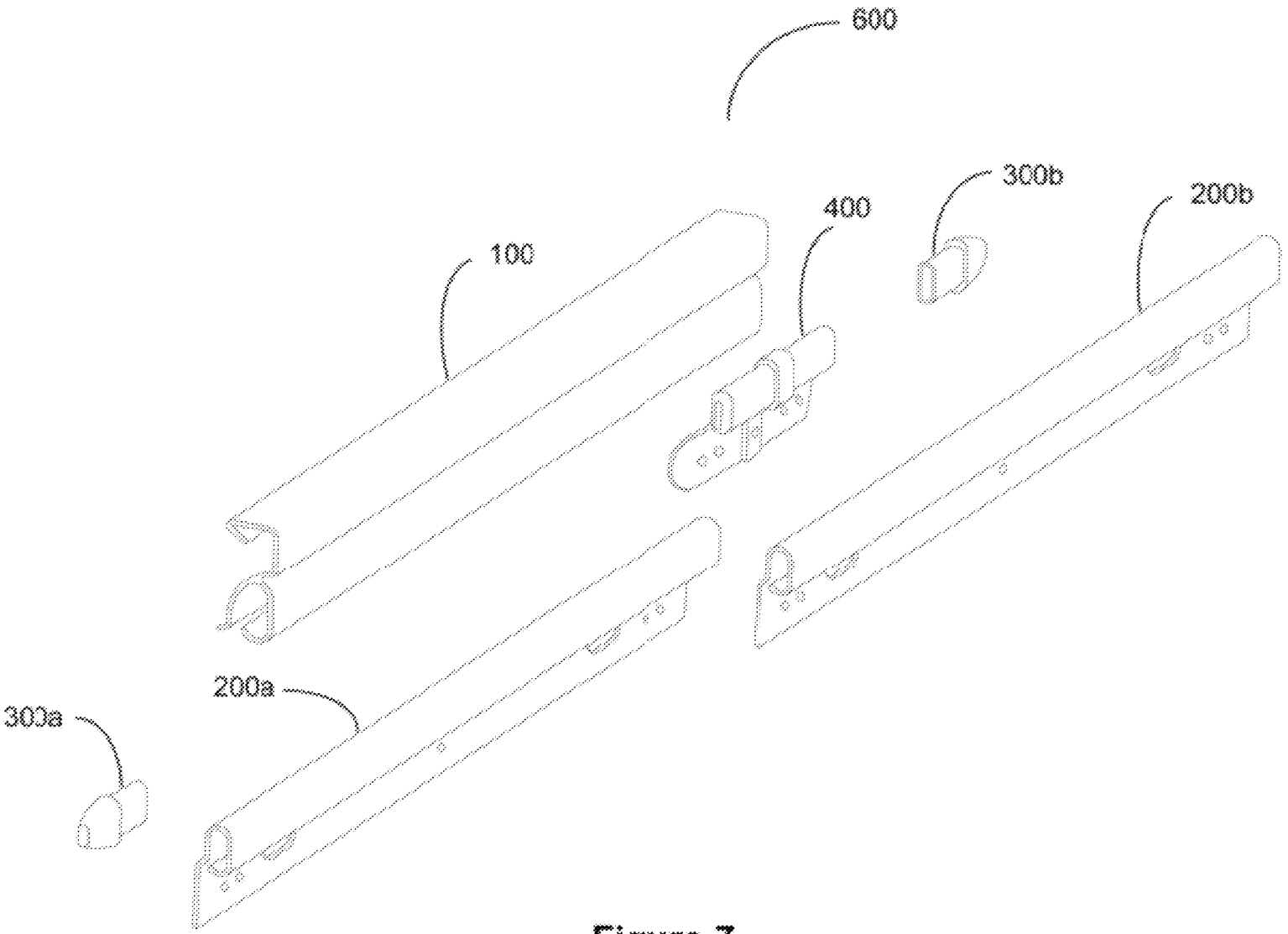
FIG. 7 illustrates a perspective view of components for a modular system for mounting ornamentation to roof gutters.

FIG. 7 illustrates a perspective view of modular system 600 comprised of mount component 100, rail components 200*a*, 200*b*, connector component 400 and optional insertion components 300*a*, 300*b* unassembled.

Figure 8:
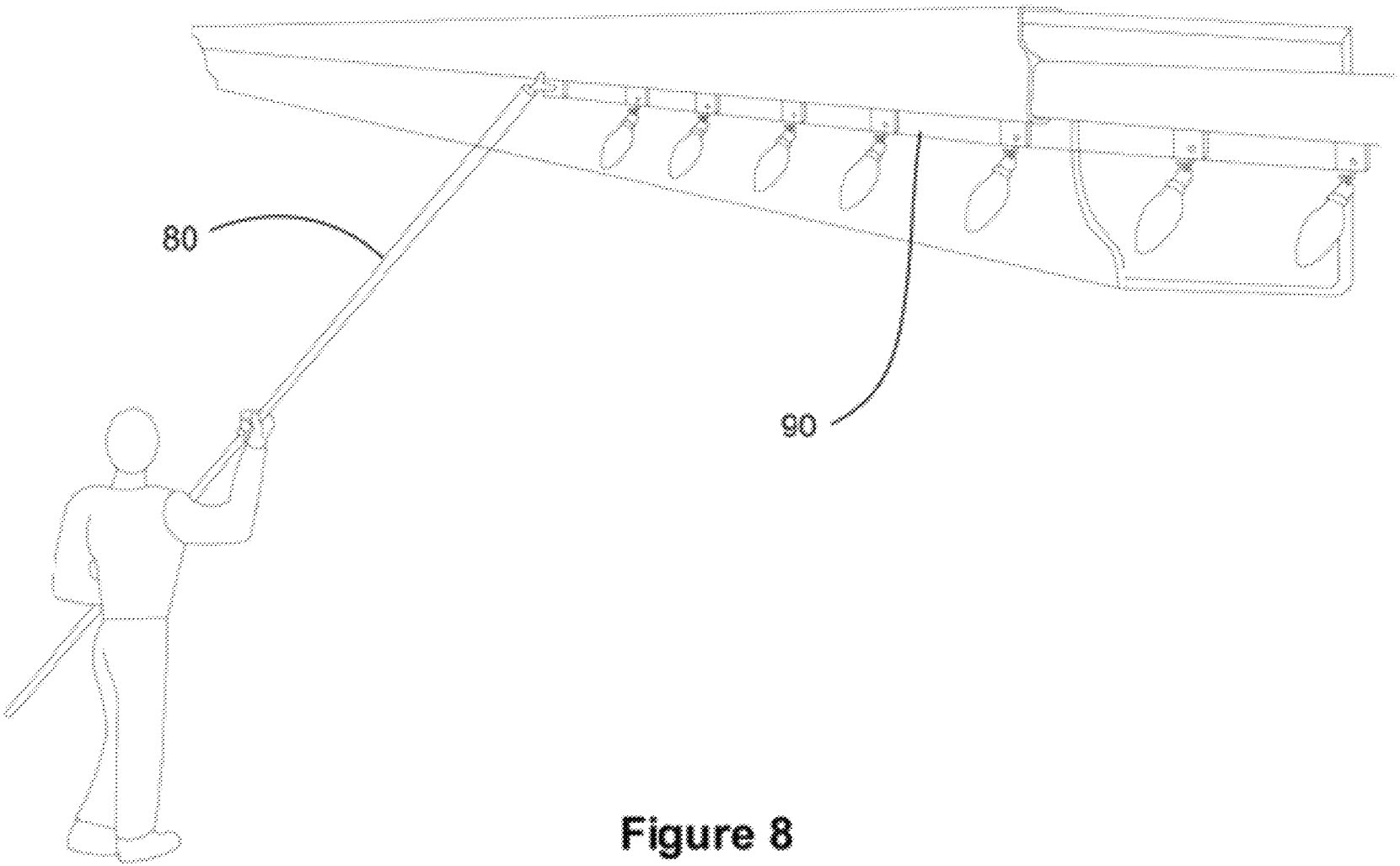
FIG. 8 illustrates a perspective view of an exemplary embodiment of a modular system for mounting ornamentation to roof gutters.

FIG. 8 illustrates a perspective view of an exemplary embodiment of modular system 600 in use. Mount components 100*a*, 100*b*, 100*c*, etc. are secured to the gutter of a roof where the lighting or signage is to be attached. In the embodiment shown, the individual mount components are not secured, but instead are pushed together.

Rail components 200*a*, 200*b*, 200*c*, etc. are secured together using connector components 400*a*, 400*b*, 400*c*, etc. String of lights 90 is secured to rail components 200 by hooks 95*a*, 95*b*, 95*c*, etc. hooked through accessory mount holes 93*a*, 93*b*, 93*c* in rail components 200 and connector components 400. In other embodiments, string of lights 90 or signage is secured to rail components 200 using clamps, ties or another securing mechanism.

Insertion component 300*b* is placed on the leading end of rail components 200 and insertion component 300*a* is placed on the end of last rail component 200. Insertion component 300*b* is inserted into opening 65 of mount components 100. Pole 80 is hooked into guiding hole 88*a* of last rail component 200 and is used to feed rail components 200 with attached string of lights 90 through mount components 100 until mount components 100 and rail components 200 line up, i.e., when end of rail components 200 reaches the end of mount components 100. Once assembled, end cap components 500*a*, 500*b* may be added to the ends of mount components 100 enclosing opening 65.

In other embodiments, instead of using pole 80 (or a string or wire) to push or pull the rail components through the mount components, the user may stand on a ladder at the point of insertion and feed the rail components through the mount components using his or her hands. In other embodiments, one or more components of modular system 600 may be motorized to facilitate the guiding of the rail components through the opening of the mount components.

Figure 9A:
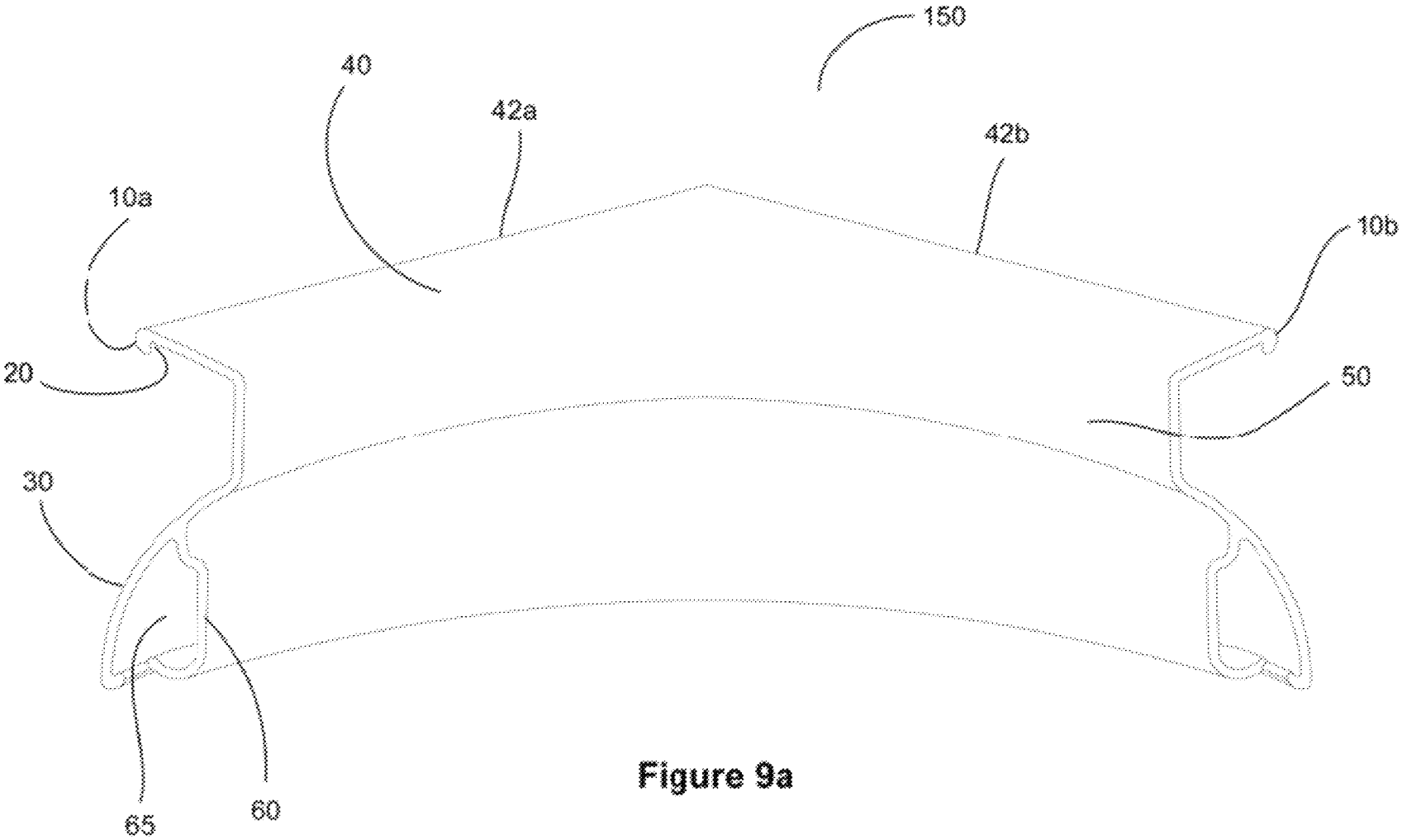
FIG. 9*a* illustrates a perspective view of an exemplary embodiment of curved mount component for a 90 degree inside gutter turn.

FIG. 9*a* illustrates a perspective view of an exemplary embodiment of curved mount component 150 for a 90 degree inside gutter turn (e.g., a roof peak). Mount component 150 has top portion 40, front portion 50, contoured track mount housing 60 and gutter contour 30. In the embodiment shown, front portion 50 is curved and top portion 40 has first and second edges 42*a*, 42*b* which form a 90 degree angle. In other embodiments, first and second edges 42*a*, 42*b* may form an angle ranging from 30 degrees to 120 degrees.

In the embodiment shown, curved mount component 150 is comprised of a semi-rigid polyvinyl chloride (PVC) that is weather resistant and which is made by extrusion. In other embodiments, curved mount component 150 may be comprised of another type of plastic (e.g., polystyrene, nylon), rubber, metal or any other semi-rigid material and may be machined, molded, cast, stamped or bent.

First and second edges 42*a*, 42*b* of top portion 40 rest on the gutters along the roof peak. First and second edges 42*a*, 42*b* further include securing protuberance 10*a*, 10*b* which hook around and engage the gutter along the roof peak. Angle of engagement 20 between the horizontal top portion 40 and securing protuberances 10*a*, 10*b* creates tension with standard size k style gutters and holds curved mount component 150 against the gutter.

In an exemplary embodiment, first and second edges 42*a*, 42*b* of curved mount component 150 have a length of 1 foot. In other embodiments, curved mount component 150 has shorter or longer edges.

Figure 9B:
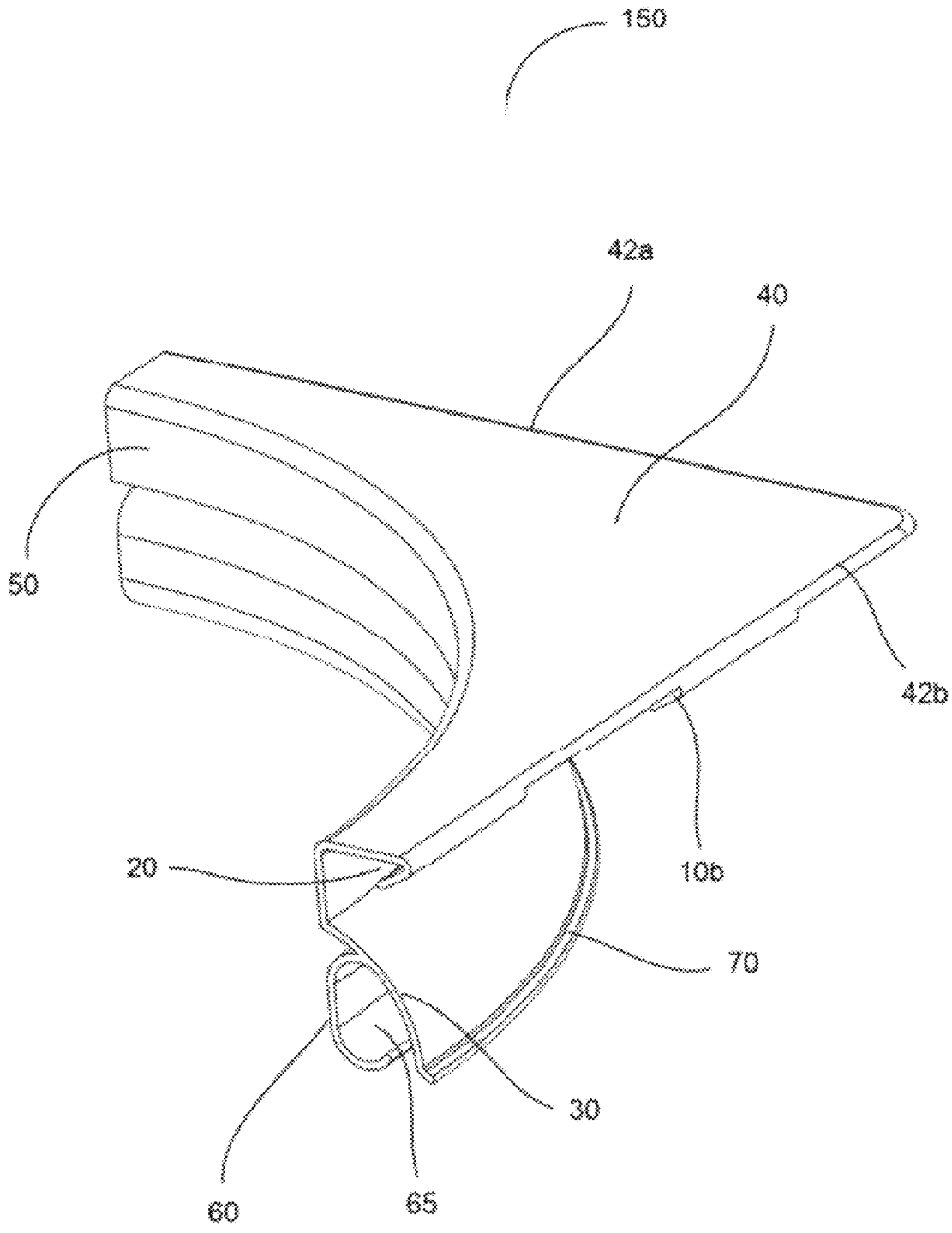
FIG. 9*b* illustrates a perspective view of an exemplary embodiment of a curved mount component for a 90 degree inside gutter turn.

FIG. 9*b* illustrates a perspective view of an exemplary embodiment of curved mount component 150 for a 90 degree inside gutter turn. FIG. 9*b* further illustrates top portion 40, securing protuberance 10*b* and spacer component 70.

Figure 10:
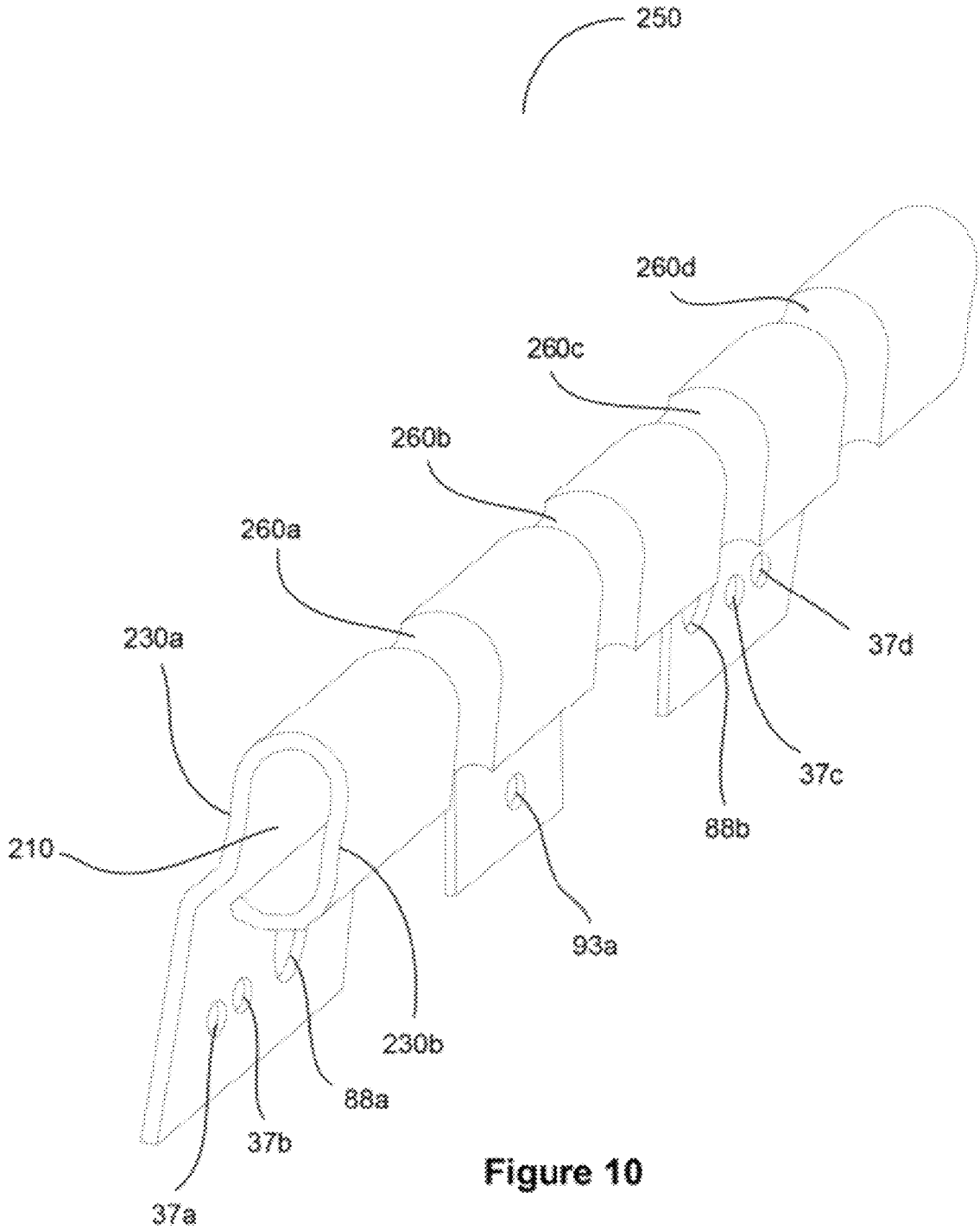
FIG. 10 illustrates a perspective view of an exemplary embodiment of a rigid rail component for a curved mount component.

FIG. 10 illustrates a perspective view of an exemplary embodiment of rigid rail component 250 for curved mount component 150. Rigid rail component has structural contours 230*a*, 230*b* which form hollow channel 210 and joints 260*a*, 260*b*, 260*c*, 260*d* which allow rigid rail component 250 to bend as it is guided through curved mount component 150. Rigid rail component 250 can also be used with mount component 100.

In the embodiment shown, joints 260*a*, 260*b*, 260*c*, 260*d* are reverse ribbed and are formed by stamping or pressing. In other embodiments, rigid rail component 250 does not contain joints 260, but rather is made out of a rigid material which allows it bend. In other embodiments, tabs, serrations, hinges or are of another structural designs allows rigid rail component 250 to bend or flex.

In the embodiment shown, structural contour 230*a* further includes friction reducing ridges 220*a*, 220*b* which reduce friction between rigid rail component 250 and inner surface of contoured track mount housing 60 (not shown) of mount component 100 or curved mount component 150. Friction reducing ridges 220*a*, 220*b* also allow for expansion and contraction while securing mount component 150 allowing rail component to be removed in all weather conditions.

Rigid rail component 250 further includes apertures 37*a*, 37*b*, 37*c*, 37*d* adapted to receive pins of connector component 400, guiding holes 88*a*, 88*b* for connecting pole 80 (not shown) and accessory mount hole 93*a* for securing accessories (e.g., string of light or signage). In other embodiments, rigid rail component 250 may have more or fewer apertures, guiding holes, and/or accessory mount holes or have them in varying locations.

What is claimed is:

1. A modular mounting apparatus comprised of:

at least one mount component abutting and in physical contact with at least one other mount component, wherein said at least one component is comprised of:

a substantially horizontal top portion having a securing protuberance curved at an angle of engagement adapted to engage and rest securely on a gutter;

wherein said substantially horizontal top portion is connected to a substantially vertical front portion and gutter contour, wherein said angle of engagement creates tension between said at least one mount component and said gutter holding said mount component against said gutter, and at least one opening;

at least one rail component comprised of an contoured structure with an outer surface conforming to said opening and forming hollow channel and a vertical section which includes at least one accessory mount hole and at least one guiding hole, wherein said rail component is adapted to move slidably within said opening;

at least one connector component comprised of a slide member with an outer surface conforming to said hollow channel and back portion having at least one pin and at least one accessory mount hole;

wherein said at least one rail component is further connected to at least one other rail component by said at least one connector component, wherein said slide member slidingly engages said hollow channel of said at least one rail component and said back portion engages said vertical section of said at least one rail component; and at least one insertion component selectively attachable to said at least one rail component and adapted to slidably engage said opening of said at least one mount component.

2. The mounting apparatus of claim 1 wherein said mount component is comprised of a first mount component placed at an angle ranging from 30 degrees to 120 degrees to a second mount component.

3. The mounting apparatus of claim 1 which further includes at least one end cap which encloses said at least one opening of said mount component.

4. The mounting apparatus of claim 1 which further includes at least one spacer component.

5. The mounting apparatus of claim 1 wherein said at least one rail component further includes a bowed vertical surface.

6. The mounting apparatus of claim 1 wherein said at least one rail component further includes at least one ridge to reduce friction.

7. The mounting apparatus of claim 1 wherein said at least one rail component has apertures adapted to receive said at least one pin of said at least one connector component.

8. A modular system for mounting lighting and signage comprised of:

at least one mount component adapted to abut against at least one other mount component, wherein said at least one mount component is comprised of a substantially horizontal top portion having a securing protuberance adapted to rest securely on a gutter, wherein said substantially horizontal top portion is connected to a substantially vertical front portion and gutter contour, an angle of engagement between said substantially horizontal top portion and said securing protuberance which creates tension between said mount component and said gutter holding said mount component against said gutter, and an opening;

at least one connector component;

at least one rail component connected to at least one other rail component by said at least one connector component, said at least one rail component having at least one accessory mount hole and at least one guiding hole, wherein said at least one rail component is adapted to move slidably within said at least one mount component; and at least one insertion component selectively attachable to said at least one rail component and adapted to slidably engage said opening of said at least one mount component.

9. The modular system of claim 8 wherein said horizontal top portion is bent at an angle corresponding to an angle of a gutter corner and said opening is curved.

10. The modular system of claim 8 which further includes at least one end cap.

11. The modular system of claim 8 wherein said at least one connector component is comprised of:

a slide member; and a back portion having at least one pin and at least one accessory mount hole;

wherein said connector component connects said at least one rail component to a second rail component.

12. The modular system of claim 11 wherein said at least one rail component has apertures adapted to receive said at least one pin of said at least one connector component.

13. A method of making a modular system for mounting lighting and signage comprised of:

creating at least one mount component having a gutter contour, a substantially vertical front portion, a substantially horizontal top portion having a securing protuberance adapted to rest securely on a gutter and connected to said substantially vertical front portion and said gutter contour, an angle of engagement between said substantially horizontal top portion and said securing protuberance to create tension between said mount component and said gutter holding said mount component against said gutter and an opening, wherein said at least one mount component is adapted to abut against at least one other mount component;

creating at least one connector component having a slide member and a back portion, said back portion having at least one pin and at least one accessory mount hole;

creating at least one rail component adapted to connect to at least one other rail component by said connector component and move slidably within said at least one mount component, said at least one rail component having at least one accessory mount hole and at least one guiding hole; and creating at least one insertion component selectively attachable to said at least one rail component and adapted to slidably engage said opening of said at least one mount component.

* * * * *